United States Patent [19]

Lawson

[11] 4,042,154

[45] Aug. 16, 1977

[54] DRAPERY MARKING APPARATUS

[76] Inventor: Jack M. Lawson, 3161 Ashwood, No. 3, Memphis, Tenn. 38118

[21] Appl. No.: 729,103

[22] Filed: Oct. 4, 1976

[51] Int. Cl.[2] ..... A41H 43/00

[52] U.S. Cl. ..... 223/28

[58] Field of Search ..... 160/330, 348; 33/180 R, 33/180 B, 18 R, 189–192, 174; 223/28–33

[56] References Cited

U.S. PATENT DOCUMENTS

| | | | |
|---|---|---|---|
| 2,777,617 | 1/1957 | Matt | 223/28 X |
| 2,853,793 | 9/1958 | Ripp et al. | 223/28 X |
| 2,998,659 | 9/1961 | Yaworsky | 223/28 X |
| 3,058,634 | 10/1962 | Wieneke | 223/28 |
| 3,166,854 | 1/1965 | Parker et al. | 223/28 X |
| 3,297,215 | 1/1967 | Soto | 223/28 |
| 3,473,706 | 10/1969 | Stahl | 223/31 |
| 3,591,061 | 7/1971 | Boyes | 223/32 |
| 3,633,800 | 1/1972 | Wallace | 223/28 |
| 3,696,515 | 10/1972 | Tuskas | 223/32 X |

*Primary Examiner*—G. V. Larkin
*Attorney, Agent, or Firm*—John R. Walker, III

[57] ABSTRACT

An apparatus for use in manually marking the locations on the upper section of a drapery panel where fold-type drapery supports should be mounted. A computing device is utilized to determine the correct distance between adjacent fold-type drapery supports to obtain a desired number of folds for a given hemmed width size of drapery panel. A plurality of indicator members for indicating where marks should be manually made on the upper section of a drapery panel are provided on a lazy tong-like member which is adapted to allow the distance between each adjacent indicator member to be uniformly varied in accordance with the computations of the computing device.

9 Claims, 11 Drawing Figures

DRAPERY MARKING APPARATUS

BACKGROUND OF THE INVENTION

1. Field of the Invention

This invention relates generally to devices for use in the manufacture of fold-type drapery panels.

2. Description of the Prior Art

Applicant is aware of the following patents: Lawson U.S. Pat. No. 3,822,034 and Packer et al., U.S. Pat. No. 3,166,854. Neither of the above patents disclose, teach or suggest the present invention.

Lawson, U.S. Pat. No. 3,822,034, discloses a combination marking device for pinch pleat and fold-type draperies but does not allow for the smaller 2⅛ inches full swivel fold-type spacing and requires two operations to locate a finished width on the scale because the marking for a pleated drapery heading requires a separate figure for the pleat and for the space. Packer et al. does not show predetermined computations nor allow for fold-type draperies.

SUMMARY OF THE INVENTION

The present invention is directed towards providing an apparatus to indicate the locations for attaching fold-type drapery supports to a drapery panel so as to obtain a desired number of folds in the drapery panel. The concept of the present invention is to provide an apparatus which includes computing means for determining the correct distance between adjacent fold-type drapery supports to obtain a desired number of folds for a given hemmed width size of drapery panel, a plurality of indicator means for indicating where the fold-type drapery supports should be mounted on the drapery panel, and adjustment means for uniformly moving the plurality of indicator means to allow the distance between each adjacent indicator means to be uniformly varied in accordance with the computations of the computing means.

Figure 1:
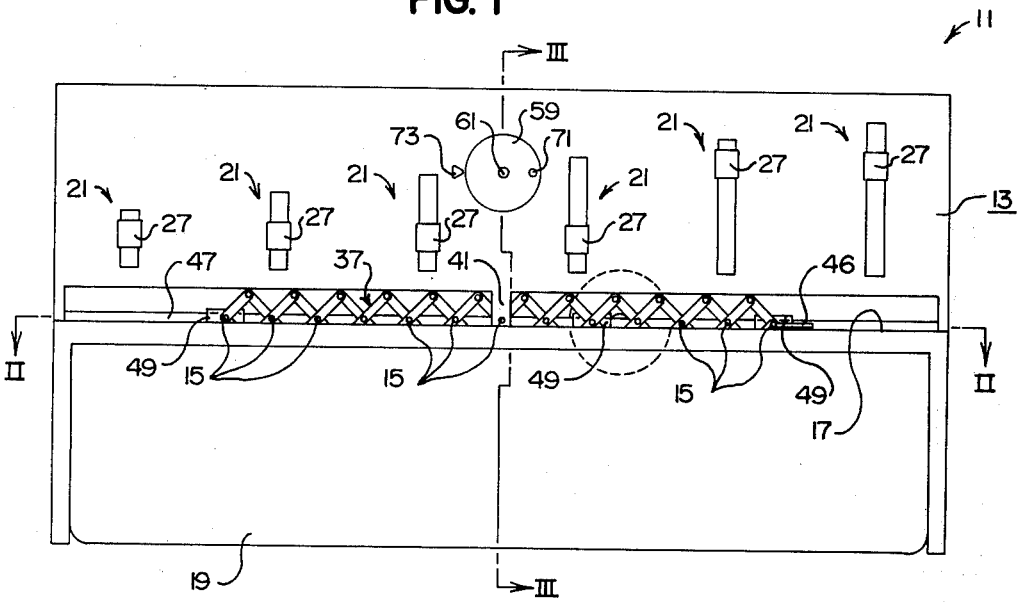
FIG. 1 is a front elevational view of the apparatus of the present invention.

F'G. 3 is a sectional view thereof as taken on line III—III of FIG. 1.

Figure 4:
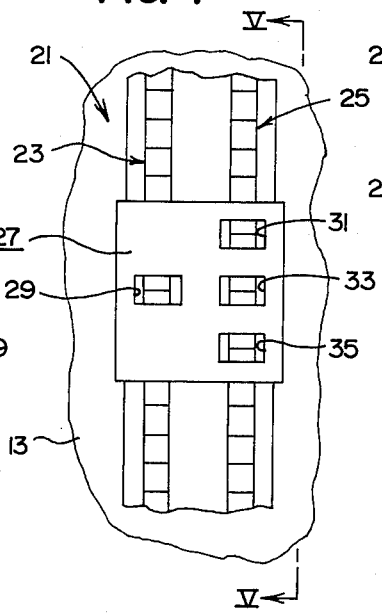

FIG. 4 is a detail view of a portion of the computing means of the apparatus of the present invention.

Figure 5:
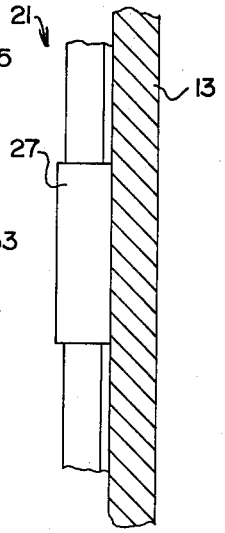

FIG. 5 is a sectional view thereof as taken on line V—V of FIG. 4.

Figure 6:
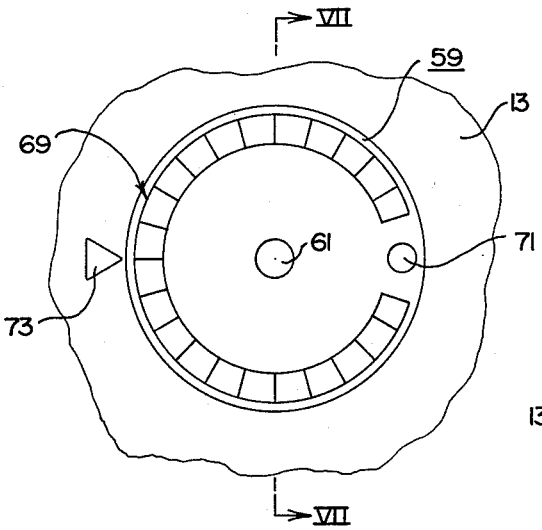

FIG. 6 is a detail view of a portion of the adjustment means of the apparatus of the present invention.

Figure 7:
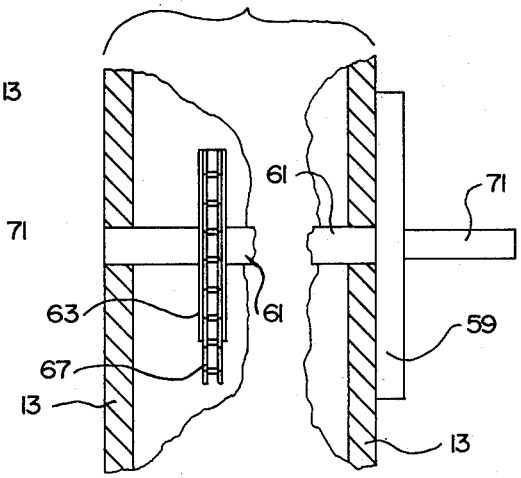

FIG. 7 is a sectional view thereof as taken on line VII—VII of FIG. 6.

Figure 8:
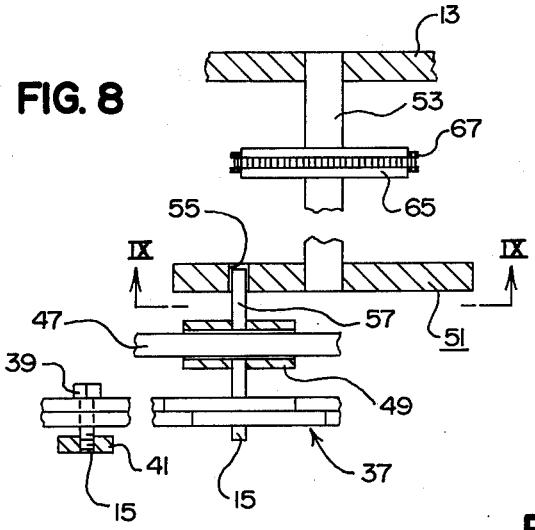

FIG. 8 is a sectional detail view of another portion of the adjustment means of the apparatus of the present invention.

Figure 9:
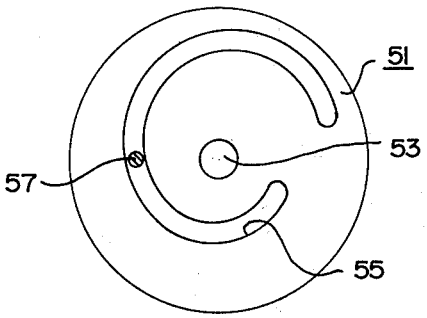

FIG. 9 is a sectional view thereof as taken on line IX—IX of FIG. 8.

Figure 10:
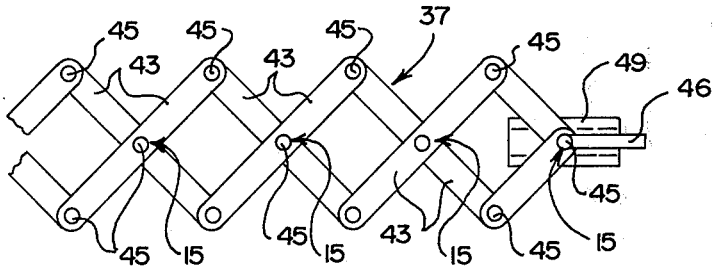

FIG. 10 is a detail front elevational view of another portion of the adjustment means of the apparatus of the present invention.

Figure 11:
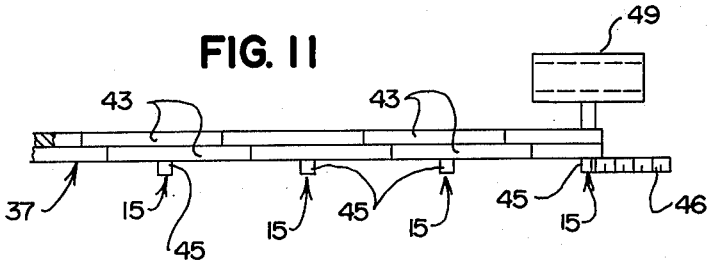

FIG. 11 is a top plan view of FIG. 10.

DESCRIPTION OF THE PREFERRED EMBODIMENT

Figure 2:
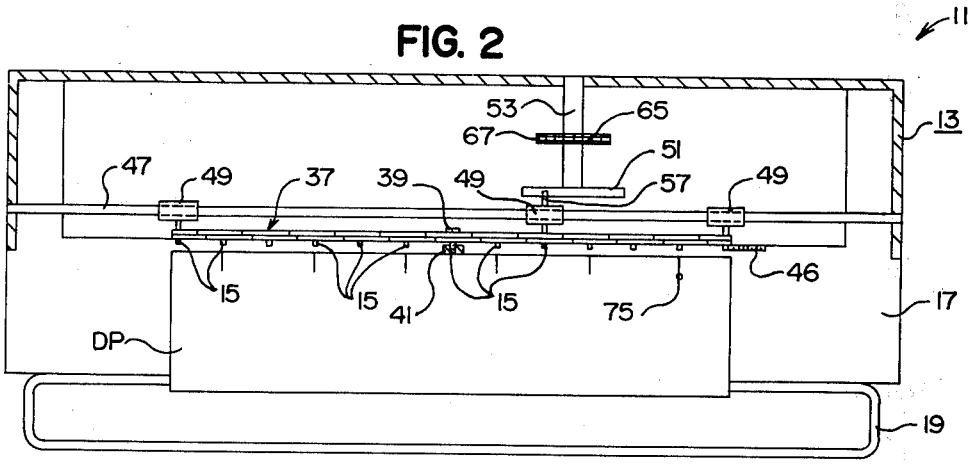
FIG. 2 is a sectional view thereof as taken on line II—II of FIG. 1.
Figure 3:
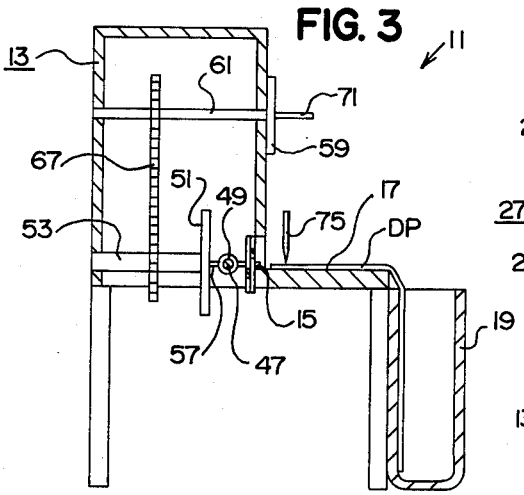

The apparatus 11 of the present invention is for use in mounting fold-type drapery supports (not shown) such as disclosed by Lawson, U.S. Pat. No. 3,916,975, to a drapery panel DP (see FIGS. 2 and 3). The apparatus 11 includes, in general, a frame 13, a plurality of indicator means 15, computing means for determining the correct, required distance between each acjacent fold-type drapery support for a given hemmed width size of a drapery panel DP to obtain a desired number of folds, and adjustment means for uniformly moving the plurality of indicator means 15 to allow the distance between each adjacent indicator means 15 to be uniformly varied.

The frame 13 conveniently may include a substantially horizontal working surface 17 for supporting at least part of the upper portion of a drapery panel DP. The frame 13 may include a bin 19 located adjacent the working surface 17 for receiving the lower portion of a drapery panel DP while the upper portion thereof is supported on the working surface 17 (see FIGS. 2 and 3).

The computing means may include a plurality of scales 21 with each of the plurality of scales 21 corresponding to a specific number of folds (It should be noted that while six scales 21 are shown in FIG. 1, the apparatus 11 may include more or less than six scales 21). For example, the computing means includes one scale 21 for drapery panels having four folds, another scale 21 for drapery panels having five folds, and so on. Additionally, each scale 21 is preferably for use with a specific range of drapery rod lengths. Each of the plurality of scales 21 includes a first column 23 of numerical indicia corresponding to the hemmed width size of various drapery panels; a second column 25 of numerical indicia corresponding to the correct, required distance between each adjacent fold-type drapery support for a given hemmed width size of drapery panel to obtain a desired number of folds in the drapery panel; and a movable slide or cursor 27 having a first window means 29 for selective alignment with a numerical indicium of the first column 23 and having a second window means 31 for alignment with a numerical indicium of the second column 25 to show the correct, required distance between each adjacent fold-type drapery support for a given hemmed width size of a drapery panel to obtain a desired number of folds. Preferably, the movable cursor 27 also includes third and fourth window means 33, 35 (see FIG. 4) for alignment with numerical indicia of the second column 25 to offer a selection of "returns" (i.e., the flat portion of the drapery from the drapery rod back to the wall). More specifically, the second window means 31 may be used to indicate the correct, required distance between each adjacent fold-type drapery support for a given hemmed width size of drapery panel to obtain a desired number of folds with a 5½ inch return. The third window means 33 may be used to indicate the correct, required distance between each adjacent fold-type drapery support for a given hemmed width size of a drapery panel to obtain a desired number of folds and a 3½ inch return. The fourth window means 35 may be used to indicate the correct, required distance between each adjacent fold-type drapery support for a given hemmed width size of a drapery panel to obtain a desired number of folds and a 1½ inch return. The cursor 27 may be constructed of an opaque material and the window means 29, 31, 33, 35 may consist simply of apertures or openings through the cursor 27.

The adjustment means may include a lazy tong-type means 37 fixedly mounted to the frame 13. The lazy tong means 37 may be fixedly mounted to the frame 13 in any manner apparent to those skilled in the art. For example, a bolt 39 or the like may pass through one of the pivots of the lazy tong means 37 to fixedly attach the lazy tong means 37 to a portion 41 of the frame 13 (see FGS. 2 and 8). The plurality of indicator means 15 are preferably mounted equal distance from one another on the lazy tong means 37 so that when the lazy tong means 37 is extended or contracted, the distance between each adjacent indicator means 15 will be uniformly extended or contracted. More specifically, the lazy tong means 37 is primarily constructed of elongated members 43 (see FIG. 10). Each elongated member 43 is pivotally attached to other elongated members at each end and in the center therof by pivots 45 in a manner like that of similar lazy tong devices and which should be apparent to those skilled in the art. Scale-like means 46 (see FIGS. 2, 10 and 11) may be attached to one or both ends of the lazy tong means 37 for reasons which will hereinafter become apparent. Each indicator means 15 may consist of an indicia mark fixedly mounted on the lazy tong means 17. That is, each indicator means 15 may consist of a painted mark located on certain ones of the pivots 45. Preferably, the painted marks are provided on each pivot 45 that pivotally connects the center of one elongated member 43 to another elongated member 43 (see FIG. 10). The plurality of indicator means 15 are preferably alternately marked in a contrasting manner for reasons which will hereinafter become apparent. For example, the plurality of indicator means 15 may be alternately painted black and white. It should be noted that the heads of the pivots 45 which are utilized as the indicator means 15 are enlarged somewhat in FIGS. 2 and 3 to more clearly illustrate the indicator means 15.

A shaft 47 may be fixedly mounted to the frame 13 behind the lazy tong means 37 as shown in FIGS. 1, 2, 3, and 8 to give additional support to the lazy tong means 37. That is, a plurality of sleeve members 49 are preferably slidably mounted on the shaft 47 and fixedly attached to the lazy tong means 37 in any manner apparent to those skilled in the art. For example, certain of the pivots 45 joining the elongated members 43 of the lazy tong means 37 together may be elongated to pass through the elongated members 43 and be fixedly attached to the sleeve members 40 by welding or the like.

The adjustment means additionally preferably includes cam means mounted to the frame 13. The cam means includes a cam member 51 rotatably mounted to the frame 13 by a shaft 53 or the like, with cam member 51 being fixedly attached to shaft 53. The cam member 51 consists of a disc-like member having a spiral-like groove 55 located thereon. The cam means also includes a cam follower member 57 operatively coupled to the lazy tong means 37 for selectively extending and contracting the lazy tong means 37 in response to the movement of the cam member 51 thereby uniformly varying the distance between each adjacent indicator means 15. The cam follower member 57 may consist of an elongated rod-like member which extends into the groove 55 in the cam member 51 and which is fixedly attached as by welding or the like to one of the sleeve members 49 which is, in turn, fixedly attached to the lazy tong means 37 as can be clearly seen in FIG. 8. Thus, it should be readily apparent to one skilled in the art that when the cam member 51 is rotated, the cam follower member 57 will cause the lazy tong means 37 to extend and, or contract in response to the rotation of the cam member 51.

The adjustment means also includes means for allowing the distance between each indicator means 15 to be accurately set to the required distance as determined by the computing means. This means includes a movable member 59 operatively connected to the cam member 51 so that the cam member 51 will be moved or rotated when the movable means 59 is moved or rotated. More specifically, the movably means 59 is preferably rotatably attached to the frame 13 by a shaft 61 or the like. A sprocket 63 is fixedly attached to the shaft 61 and a sprocket 65 is fixedly attached to the shaft 53. An endless chain 67 extends between the sprockets 63, 65 so that when the shaft 61 is rotated, the shaft 53 will be caused to rotate. The movable member 59 may be disc-like and may include a circular column 69 of numerical indicia which corresponds to the various distances between adjacent fold-type drapery supports. A handle 71 is preferably attached to the movable member 59 to aid in the rotation thereof. The means for allowing the distance between each indicator means 15 to be accurately set also includes a pointer means 73 fixedly mounted to the frame 13 for pointing to the numerical indicium of the column 69 that corresponds to the spaced apart distance of adjacent indicator means 15. The pointer means 73 may consist simply of a pointed arrowlike member on the frame 13 adjacent the movable member 59 as shown in FIGS. 1 and 6.

In the operation of the apparatus 11, the first step is to determine the width of the hemmed drapery panel DP onto which fold-type drapery supports are to be mounted, the number of folds desired in the finished drapery panel, and the length of the drapery rod which the finished drapery panel is to be used with. Next, the movable cursor 27 of the scale 21 which corresponds to the desired number of folds and the length of drapery rod which the finished drapery panel is to be used with is moved so that the first window means 29 thereof is centered over the numerical indicium of the first column 23 thereof which corresponds to the width of the hemmed drapery panel DP. The correct, required distance between adjacent fold-type drapery supports to obtain the desired number of folds for the given hemmed width size of the drapery panel DP is then visible through the second, third, or fourth window means 31, 33, 35 of the cursor 27, depending on the desired return size.

Next, the movable member 59 is rotated until the correct, required distance between the adjacent fold-type drapery supports is aligned with the pointer means 73.

Then, the upper portion of the drapery panel DP is placed upon the working surface 17 of the frame 13 adjacent the plurality of indicator means 15. The inner edge of the drapery panel DP is aligned with one of the scale-like means 46 which includes indicia for establishing the distance between the inner edge of the drapery panel DP and the center of the first fold thereof (i.e., the overlap portion of the drapery panel DP). It should be noted that the overlap portion of a drapery panel DP is that portion which falls in the center of a pair of drapery panels so that when the pair of drapery panels are closed, the overlap portion of each drapery panel extends over one another to form the closure. Marks are then manually made on the drapery panel DP with an appropriate marker means 75 (e.g., a black light pencil means well known to those skilled in the art) adjacent the indicator means 15. It should be noted that for draperies using 2⅛ inch spacing between carriers, marks are made on the drapery panel DP adjacent every indicator means 15. On the other hand, for draperies using 4¼ inch spacing between carriers, marks are made on the drapery panel DP only adjacent every other indicator means 15. Once the marks have been so made on the drapery panel DP, the fold-type drapery supports can be attached to the drapery panel DP adjacent the marks in any manner well known to those skilled in the art.

Although the invention has been described and illustrated with respect to a preferred embodiment thereof, it is not to be so limited since changes and modifications may be made therein which are within the full intended scope of the invention.

I claim:

1. An apparatus for use in mounting fold-type drapery supports to a drapery panel, said apparatus comprising:

a. a frame;

b. a plurality of indicator means movably supported adjacent said frame for indicating where the fold-type drapery supports should be mounted on the drapery panel;

c. computing means mounted on said frame for determining the required distance between each adjacent fold-type drapery support for a given hemmed width size of a drapery panel to obtain a desired number of folds; and d. adjustment means for uniformly moving said plurality of indicator means to allow the distance between each adjacent indicator means to be uniformly varied, said adjustment means being mounted to said frame, each of said plurality of indicator means being mounted on said adjustment means, said adjustment means including a cam means mounted to said frame and including a lazy tong means fixedly mounted to said frame, said cam means including a cam member and a cam follower member, said cam follower member being operatively coupled to said lazy tong means for selectively extending and contracting said lazy tong means in response to the movement of said cam member.

2. The apparatus of claim 1 in which each of said plurality of indicator means is mounted equal distance from one another on said lazy tong means so that when said lazy tong means is extended or contracted in response to the movement of said cam means, the distance between each adjacent indicator means will uniformly be extended or contracted.

3. The apparatus of claim 2 in which each of said plurality of indicator means consist of an indicia mark fixedly mounted on said lazy tong means.

4. The apparatus of claim 1 in which said computing means includes a plurality of scales, each of said plurality of scales corresponding to a specific number of folds, each scale including:

a. a first column of numerical indicia corresponding to the hemmed width size of various drapery panels;

b. a second column of numerical indicia corresponding to the required distance between each adjacent fold-type drapery support for a given hemmed width size of drapery panel to obtain a desired number of folds;

c. a movable cursor having a first window means for selective alignment with a numerical indicium of said first column and having a second window means for alignment with a numerical indicium of said second column to show the required distance between each adjacent fold-type drapery support for a given hemmed width size of a drapery panel to obtain a desired number of folds.

5. The apparatus of claim 4 in which said movable cursor includes third and forth window means for alignment with numerical indicia of said second column; said second, third and fourth window means showing the required distance between each adjacent fold-type drapery supports for a given hemmed width size of a drapery panel to obtain a desired number of folds and for various size return portions.

6. The apparatus of claim 4 in which said adjustment means includes means for allowing the distance between each indicator means to be accurately set to the required distance shown by said second window means of said movable cursor of said computing means, said means including a movable member operatively connected to said cam member of said cam means of said adjustment means so that said cam member will be moved when said movable member is moved, said movable member including a column of numerical indicia corresponding to various distances between adjacent fold-type drapery supports, said means including pointer means fixedly mounted to said frame for pointing to the numerical indicium corresponding to the spaced apart distance of adjacent indicator means.

7. An apparatus for use in manually marking locations for mounting fold-type drapery supports to a drapery panel, said apparatus comprising:

a. a frame, said frame including a substantially horizontal working surface for supporting at least part of the upper portion of a drapery panel;

b. a plurality of indicator means movably supported adjacent said working surface of said frame for indicating where marks should be manually made on a drapery panel to show where the fold-type drapery supports should be attached thereto;

c. computing means for determining the required distance between each adjacent fold-type drapery support for a given width size of a drapery panel to obtain a desired number of folds; and d. adjustment means for uniformly moving said plurality of indicator means to allow the distance between each adjacent indicator means to be uniformly varied, said adjustment means including a lazy tong means fixedly mounted to said frame, each of said plurality of indicator means being mounted equal distance from one another on said lazy tong means, said adjustment means including cam means mounted to said frame, said cam means including a cam member and a cam follower member, said cam follower member being operatively coupled to said lazy tong means for selectively extending and contracting said lazy tong means in response to the movement of said cam member thereby uniformly varying the distance between each adjacent indicator means, said adjustment means including means for allowing the distance between each indicator means to be accurately set to the required distance between each adjacent fold-type drapery support as determined by said computing means, said means including a movable member operatively connected to said cam member so that said cam member will be moved when said movable member is moved, said movable member including a column of numerical indicia corresponding to the various distance between adjacent indicator means, said means including a pointer means fixedly mounted to said frame for pointing to the numerical indicium corresponding to the spaced apart distance of adjacent indicator means.

8. The apparatus of claim 7 in which said computing means includes a plurality of scales, each of said plurality of scales corresponding to a specific number of folds, each scale including:

a. a first column of numerical indicia corresponding to the hemmed width size of various drapery panels;

b. a second column of numerical indicia corresponding to the required distance between each adjacent fold-type drapery support for a given hemmed width size of a drapery panel to obtain a desired number of folds;

c. a movable cursor having a first window means for selective alignment with a numerical indicium of said first column to show the required distance between each adjacent fold-type drapery support for a given hemmed width size of a drapery panel to obtain a desired number of folds.

9. The apparatus of claim 7 in which each of said plurality of indicator means consist of an indicia mark fixedly mounted on said lazy tong means, each indicia mark being distinguishable from each adjacent indicia mark.

* * * * *